United States Patent [19]

Roling

[11] Patent Number: 4,509,799

[45] Date of Patent: Apr. 9, 1985

[54] APPARATUS FOR CONTROLLING THE POSITION OF A MINERAL MINING MACHINE

[75] Inventor: Franz Roling, Nordkirchen, Fed. Rep. of Germany

[73] Assignee: Gewerkschaft Eisenhutte Westfalia, Lunen, Fed. Rep. of Germany

[21] Appl. No.: 455,609

[22] Filed: Jan. 4, 1983

[30] Foreign Application Priority Data

Jan. 5, 1982 [DE] Fed. Rep. of Germany ..... 3200082

[51] Int. Cl.[3] ..... E21C 35/12

[52] U.S. Cl. ..... 299/42; 92/165 PR; 403/122; 403/143

[58] Field of Search ..... 299/42, 47, 33, 34, 299/31; 405/299, 297; 403/122, 143; 92/165 PR

[56] References Cited

U.S. PATENT DOCUMENTS

| | | | |
|---|---|---|---|
| 3,653,302 | 4/1972 | Noterboon | 92/165 PR |
| 3,835,753 | 9/1974 | Bunyard | 92/165 PR |
| 3,979,999 | 9/1976 | Emenaker | 92/165 PR |
| 4,031,967 | 6/1977 | Atherton | 403/143 |
| 4,327,946 | 5/1982 | Kirchbrücher | 299/33 |
| 4,366,989 | 1/1983 | Braun | 299/34 |
| 4,401,399 | 8/1983 | Becker | 405/299 |

FOREIGN PATENT DOCUMENTS

| | | | |
|---|---|---|---|
| 149416 | 11/1980 | Japan | 403/122 |
| 2100338 | 12/1982 | United Kingdom | 403/122 |

*Primary Examiner*—William F. Pate, III

*Attorney, Agent, or Firm*—Sughrue, Mion, Zinn, Macpeak and Seas

[57] ABSTRACT

Apparatus for controlling the position of a mineral mining machine, such as a plough, guided for movement along a guide comprises inclined piston and cylinder units connected via ball-and-socket joints between connectors at the ends of elongate beams guided on roof supports and brackets on a conveyor forming or supporting the guide. The cylinder of each unit has a ball at its upper end received in a socket on one of the brackets. This upper ball has a stepped profile with a shoulder and an end region of different radii of curvature.

The piston and interior of the cylinder are also stepped with innermost regions of reduced diameter. These measures reduce the overall length of the unit.

14 Claims, 4 Drawing Figures

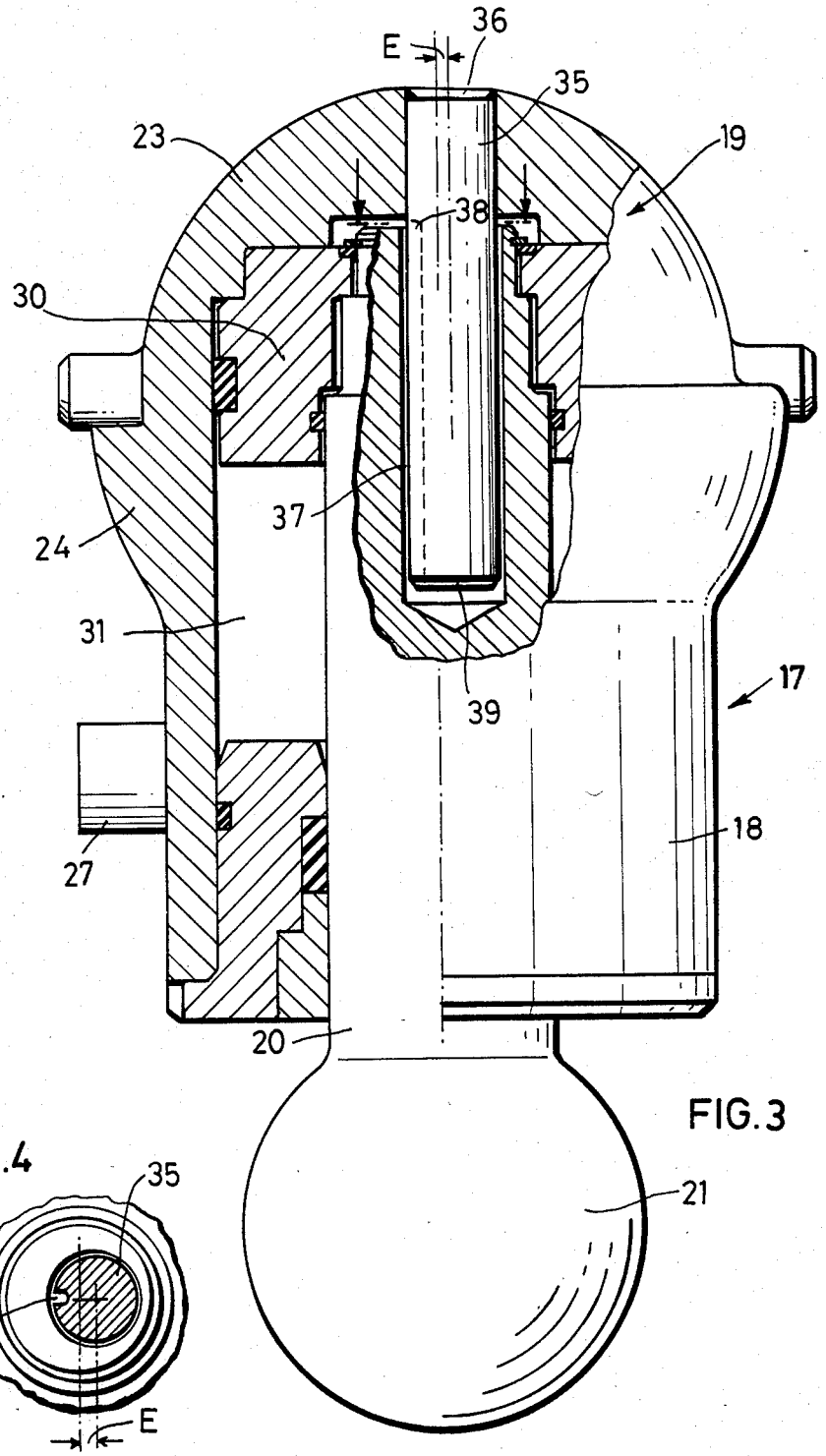
FIG.3
FIG.4
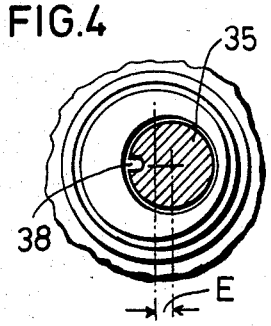

APPARATUS FOR CONTROLLING THE POSITION OF A MINERAL MINING MACHINE

BACKGROUND OF THE INVENTION

The present invention relates in general to mineral mining installation and, more particularly, to apparatus for controlling or adjusting the position of a mineral mining machine movable along guide means.

U.S. Pat. No. 4,045,089 describes apparatus of the type with which the present invention is concerned. This known apparatus comprises hydraulic piston and cylinder units coupled between brackets on a conveyor and connectors pivotably connected to the conveyor and linked to elongate beams guided on roof supports. The units can be extended or retracted to tilt the conveyor and hence a guide thereby to control the position of a machine such as a plough displaceably mounted on the guide. There is a direct relationship between the stroke of the units and the angle of tilt. The elongate beams serve to guide at least the roof supports during shifting and also act as jib-like stabilizers for bracing the system during the tilting control. The units are coupled to the connectors with the aid of ball-and-socket joints which provide flexibility enabling the apparatus to cope with the prevailing conditions in the mine working.

U.S. patent application Ser. No. 373,548 filed Apr. 30, 1982 and assigned to the same assignee as the present application discloses further developments of the apparatus described in U.S. Pat. No. 4,045,089 and is herein incorporated by reference. In accordance with the apparatus described in the aforementioned U.S. patent application Ser. No. 373,548 the units are inverted in relation to the arrangement described in U.S. Pat. No. 4,045,089 with the cylinders coupled via ball-and-socket joints at the upper ends to the brackets on the conveyor. Inter alia, this is advantageous since the units can be quite steeply inclined and take up less space.

A general object of the present invention is to provide a further improved control apparatus.

SUMMARY OF THE INVENTION

The present invention seeks to modify the construction of the units described in the aforementioned U.S. patent application Ser. No. 373,548 with a view to further reducing the size of the units. Although such units are primarily intended for use in the apparatus described in the aforementioned U.S. patent application Ser. No. 373,548 they could be used in other similar systems. The stroke of a typical piston and cylinder unit is already relatively small but a unit constructed in accordance with the present invention can provide the same force but has a shorter overall length.

As is known apparatus in accordance with the invention comprises one or more elongate rods, connection means effecting pivotal connection between a guide means along which a winning machine and said one or more rods, and at least one piston and cylinder unit connected between the guide means and the connection means with the aid of one or more ball-and-socket joints and operable to adjust the guide means.

In one aspect the present invention provides that the unit has a ball forming part of said one joint, said ball having a curvilinear end region and a curvilinear shoulder with a larger radius of curvature than that of the end region.

In another aspect the present invention provides the interior of the cylinder of said unit and the piston thereof both have a stepped profile with a reduced diameter inwardly of the unit.

By adopting both a stepped interior profile for the cylinder and the piston and a similar stepped exterior profile produced by the different radii on the ball a preferred length reduction of the unit can result.

Preferably the stepped ball is on the cylinder at the upper end of the unit. The piston rod may also join with the connection means via a ball-and-socket joint.

The end region and the shoulder of the stepped ball preferably have the same centre of curvature and the end region is preferably hemispherical.

By adopting the stepped profile for the ball of the unit the length of the unit is reduced by an amount equal to the difference in the radii of curvature of the end region and the shoulder as compared to previously-known units but without reducing the stroke of the unit. At the same time for the same stroke and axial dimension of the piston it is possible to increase the diameter of the piston without exceeding the maximum space needed to accommodate the ball. Preferably the difference between the radii of curvature of the end region and the shoulder is substantially the same as the wall thickness of the cylinder.

The maximum radius of curvature of the ball end region is determined mainly by the maximum permitted size of the complementary socket. The maximum radius of curvature for the shoulder is determined by the contact pressure on the shoulder when the unit retracts to cause the guide means to tilt upwards thereby to make the machine climb.

As to the stepped interior on the cylinder and the stepped piston it is preferable in this connection for the piston to have a stepped portion of reduced diameter which has an axial depth less than that of the main portion of the piston. The stepped interior of the cylinder preferably lies well within the stepped ball. This stepped interior profile likewise reduces the length of the unit without sacrifising strength by reducing the wall thickness of the cylinder.

Further features of the control apparatus and a installation employing same may be as described in the aforementioned U.S. patent application Ser. No. 373,548.

The invention may be understood more readily, and various other aspects and features of the invention may become apparent, from consideration of the following description.

BRIEF DESCRIPTION OF THE DRAWINGS

Embodiments of the invention will now be described by way of examples only, with reference to the accompanying drawings, wherein:

FIG. 3 is a part sectional side view corresponding to FIG. 2 but showing a further form of hydraulic control unit for use in the apparatus shown in FIG. 1; and FIG. 4 is a cross section taken along the line IV—IV of FIG. 3.

DESCRIPTION OF PREFERRED EMBODIMENTS

Figure 1:
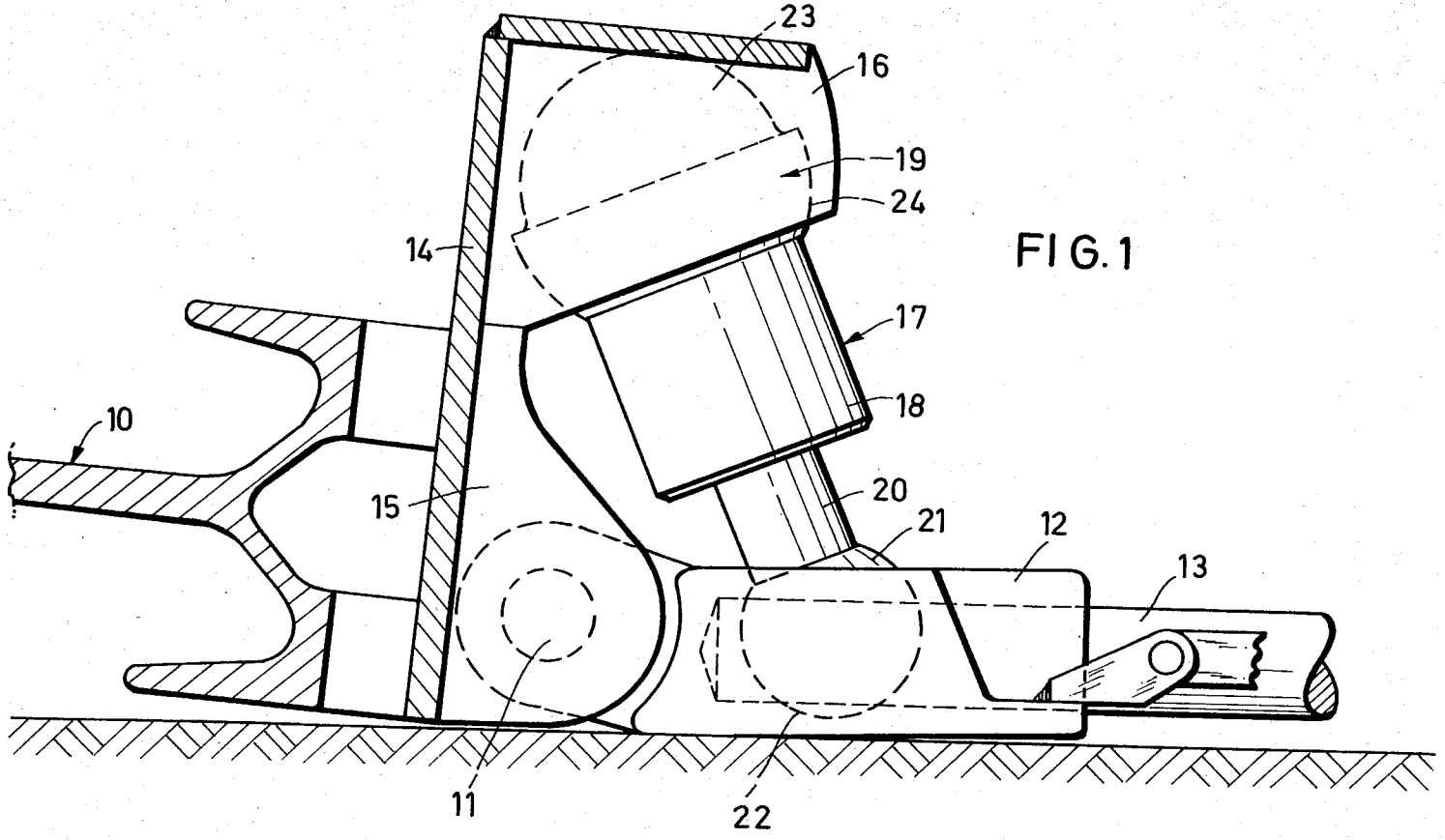
FIG. 1 is a diagrammatic part sectional side view of part of a mineral mining installation employing apparatus made in accordance with the present invention.

As shown in FIG. 1, a mineral mining installation employs a scraper-chain conveyor 10 disposed alongside a mineral face. Only part of the conveyor 10 is represented in the drawing. As is known, the conveyor 10 is composed of a series of channel sections or pans arranged end-to-end and a scraper-chain assembly circulates along the pans. The conveyor 10 can be shifted towards the mineral face in sections to follow the the winning progress. The conveyor 10 is associated with guide means (not illustrated) for a mineral winning machine, such as a plough. Normally the guide means is mounted on the mineral face side of the conveyor and the winning machine is a plough.

Apparatus is provided for tilting the conveyor to thereby control the cutting position of the winning machine guided as aforesaid. The apparatus may take the form as disclosed in the aforementioned U.S. patent application Ser. No. 373,548. Thence at the side of the conveyor 10 remote from the mineral face, i.e. on the stowage or goaf side, there are provided a plurality of support units (not shown) which serve to support the roof of the mine working. Each of these support units is connected to the conveyor 10 with the aid of a pair of elongate, parallel beams or rods 13, These jib-like rods 13 are generally of circular cross section and are inherently resilient. Each pair of rods 13 are interconnected at their front ends by way of a connector or head piece 12. Each head piece 12 is in turn connected to the conveyor 10 by way of a pivot joint 11. The axis of pivoting of the joint 11 extends longitudinally parallel to the conveyor 10 and to the machine guide means. Normally, the rear ends of the rods 13 would be guided in the direction of shifting and also allowed to pivot in relation to the supports.

The pivot joints 11 are provided on L-shaped bracket-like attachments on the goaf side of the conveyor 10. Each attachment is composed of an upstanding side plate 14 and a top plate projecting outwardly therefrom. The side plates 14 are provided with webs 15 or the like so as to partly define the pivot joints 11 with similar projections of the head pieces 12. Force-applying means is provided between each of the head pieces 12 and the associated attachment 14. This force-applying means comprises a series of double-acting hydraulic piston and cylinder units 17. These units 17 are arranged in inclined dispositions with piston rods 20 of the units at the underside of the units 17. The piston rods 20 are connected via ball-and-socket joints 21, 22 to the head pieces 12 while the cylinders 18 of the units are connected via ball-and-socket joints 19, 16 to the attachments. Each head piece 12 has a socket 22 which receives a ball 21 at the end of the piston rod 20 of the associated unit 17. Each attachment has, at its upper region between the side plates 14 and the top plate thereof, a socket 16 which is made up from a plurality of detachably interconnected components as described in the aforementioned U.S. patent application Ser. No. 373,548. The ball part 19 of each cylinder 18 thus locates in the associated composite socket 16. By extending or retracting the units 17 the conveyor 10 and the guide means can be adjusted to control the cutting position of the winning machine as described in the aforementioned U.S. patent application Ser. No. 373,548. The ball part 19 of each unit 17 is composed of an end portion 23 of hemispherical shape and a shoulder or bridge 24 which is provided between the portion 23 and the main cylinder 18.

Figure 2:
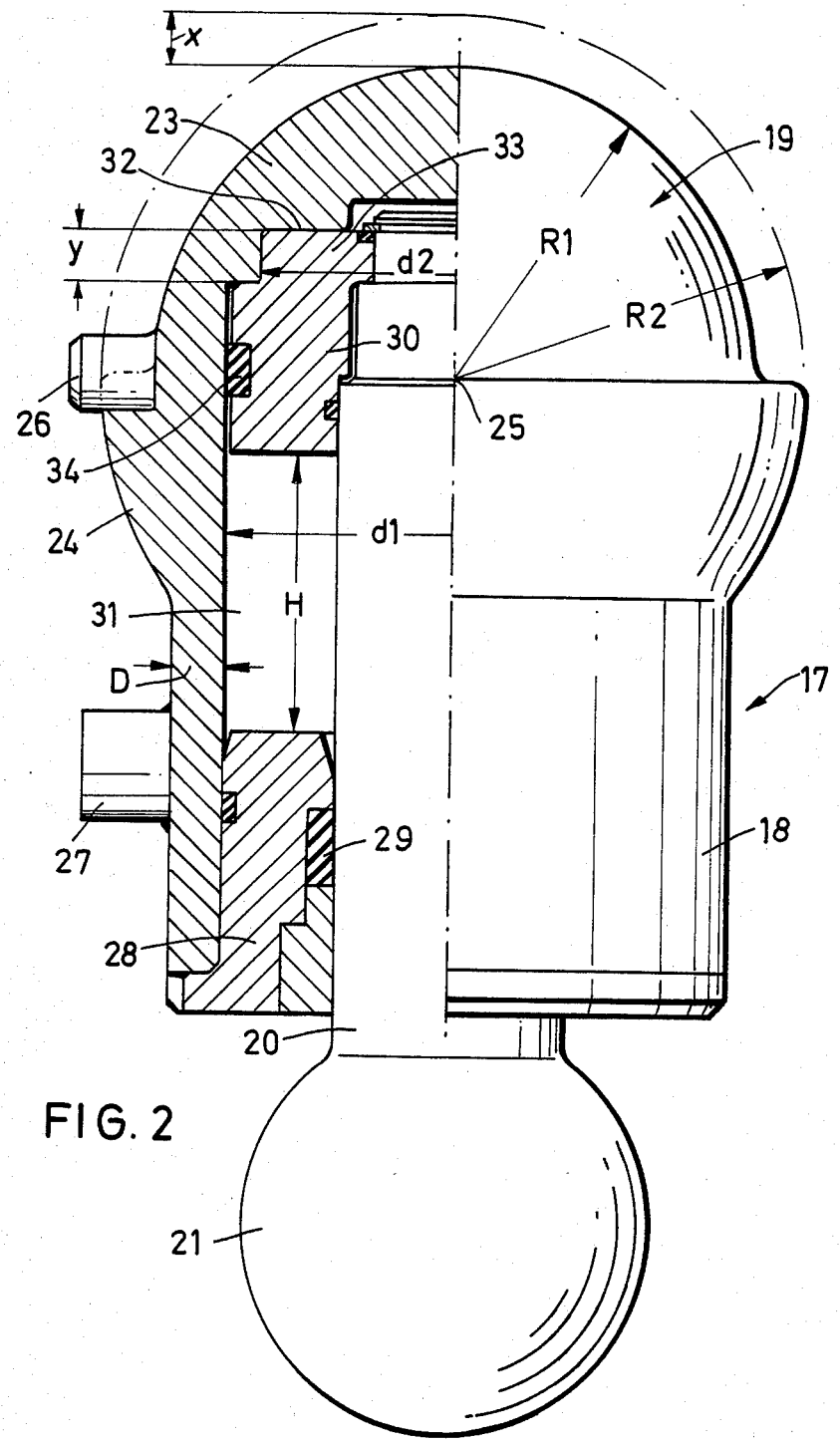
FIG. 2 is a part sectional side view of one of the hydraulic control units of the apparatus shown in FIG. 1, the view being taken on a somewhat larger scale of FIG. 1.

As shown in FIG. 2 the end portion 23 and the shoulder 24 have a common radius of curvature center designated 25. The radius of curvature R1 of the portion 23 is smaller than the radius of curvature R2 of the shoulder 24. The difference between the radii R1, R2, dimension x, is approximately equal to the wall thickness D of the cylinder 18. The centre of curvature 25 corresponds to the pivot point of the cylinder 18 in the socket 16. The socket 16 is shaped correspondingly. Because of this difference in the radii R1, R2 the overall length of the unit 17 is shorter than that of a uniform ball part as disclosed in the aforementioned U.S. patent application Ser. No. 373,548 and indicated by the chain-dotted continuation of the shoulder 24. The radius R2 is largely determined by the permissible surface pressure which occurs at the shoulder 24 and at the corresponding bearing surface of the socket 16 when the apparatus is operated so as to cause the mineral winning machine to climb. In this mode of operation each unit 17 would be pressurised to retract. The reduced radius R1 of the end portion 23 is largely determined by the greatest permissible size for the unit 17. By stepping the ball 19 in the manner described the depth dimension of the socket 16 is similarly reduced.

At the region where the portion 23 of the ball 19 adjoins the shoulder 24 a projection or attachment 26 is provided to engage in a depression in the socket 16 thereby to prevent the unit 17 turning about its longitudinal axis in the socket 16. The cylinder 18 is provided with a connector 27 for mating with a hydraulic conduit leading to an annular working chamber 31 within the cylinder 17. The chamber 31 extends within the ball 19. The lower end of the cylinder 18 is closed off by means of a cover 28 which takes the form of a bushing provided with seals of which the seal or packing 29 slidably engages on the piston rod 20. The chamber 31 lies between the inner surface of the cover 28 and a lower working face of a piston 30 fitted to the inner end of the rod 20. Another working chamber is provided within the ball 19 and hydraulic fluid can be admitted to this chamber to act on the upper working face of the piston 30 to extend the unit 17. As is known a passage can be provided in the piston rod 20 for this purpose. The maximum stroke of the unit 17 is designated by H.

Within the cylinder 18 and the ball 19 there is an internal upper stepped portion 32 having a diameter d2 which is smaller than the diameter d1 of the main part of the chamber 31. The piston 30 also has a complementary stepped portion 33. The axial depth y of the stepped portion 33 is considerably less than the main portion of the piston 30. The main portion of the piston 30 is provided with a peripheral seal 34 which slidably engages with the interior of the cylinder 18 in known manner.

The stepped portion 32, 33 of the cylinder 18 and of the piston 30 increase the overall length of the working chamber 31 and hence the stroke H without reducing the wall thickness of the cylinder 18. Because of this provision the cylinder 18 itself can be reduced in length by dimensions y while preserving the same stroke H.

The unit depicted in FIG. 3 is essentially the same as that depicted in FIG. 2 except that it is provided with an additional means for preventing relative rotation between the piston rod 20 and the cylinder 18. This means for preventing rotation takes the form of an axially-extending rod 35 welded into a bore 36 in the ball 19.

The rod 35 engages in a axially-extending blind bore 37 in the piston rod 20 which extends through the piston 30. The rod 35 and the bore 37 are offset from the axis of the cylinder 18 by an amount E so as to prevent rotation. The inner end of the bore 37 is in hydraulic communication with the upper chamber inside the cylinder 18 by way of at least one longitudinal channel 38 formed in the rod 35.

I claim:

1. In apparatus for controlling the position of a mineral mining machine movable along guide means and comprising one or more elongate rods, connection means effecting pivotal connection between the guide means and said one or more rods, and at least one piston and cylinder unit connected between the guide means and the connection means with the aid of one or more ball-and-socket joints and operable to adjust the guide means; the improvements characterized by: the unit having a ball forming part of said one joint, said ball having a curvilinear end region and a curvilinear shoulder with a larger radius of curvature than that of the end region, and means for inhibiting the rotation of said unit about its longitudinal axis.

2. Apparatus according to claim 1, wherein said ball is provided on the cylinder of the unit.

3. Apparatus according to claim 1, wherein said ball is provided at the upper end of the unit.

4. Apparatus according to claim 1, wherein the end region and the shoulder have the same centre of curvature.

5. Apparatus according to claim 1, wherein the end region of the ball is hemispherical.

6. Apparatus according to claim 2, wherein the difference between the radii of curvature of the end region and the shoulder is substantially the same as the wall thickness of the cylinder.

7. Apparatus according to claim 1, wherein said means for inhibiting rotation includes a projection at the juncture between the end region and the shoulder.

8. Apparatus according to claim 1, wherein the cylinder of the unit has a stepped interior surface and the unit has a corresponding stepped piston.

9. Apparatus according to claim 8, wherein the piston has a stepped portion of reduced diameter which has an axial depth less than that of the main portion of the piston.

10. Apparatus according to claim 1, wherein said unit is coupled to both the connection means and the guide means with ball-and-socket joints.

11. Apparatus according to claim 1 and further comprising means for inhibiting rotation between the piston and the cylinder of said unit.

12. Apparatus according to claim 2, and further comprising means for inhibiting rotation between the piston and the cylinder of said unit in the form of an axial rod located in bores in at least the piston and within the ball of the cylinder and carried by one of these components, the rod being offset from the longitudinal axis of the unit.

13. Apparatus according to claim 13, wherein the rod is fitted to the ball and a channel is provided in the rod for permitting hydraulic fluid to flow along the rod.

14. In apparatus for controlling the position of a mineral mining machine movable along guide means and comprising one or more elongate rods, connection means effecting pivotal connection between the guide means and said one or more rods, and at least one piston and cylinder unit connected between the guide means and the connection means with the aid of one or more ball-and-socket joints and operable to adjust the guide means; the improvements characterized by: the interior of the cylinder of said unit and the piston thereof both having a stepped profile with a reduced diameter inwardly of the unit, and means for inhibiting the rotation of said unit about its longitudinal axis.

* * * * *